US005244023A

United States Patent [19]

Spies

[11] Patent Number: 5,244,023

[45] Date of Patent: Sep. 14, 1993

[54] DEVICE FOR SECURING ARTICLES ON OR ABOUT THE PERSON

[76] Inventor: Albert L. Spies, 48 Saugatuck, Montgomery, Ill. 60538

[21] Appl. No.: 757,629

[22] Filed: Sep. 11, 1991

[51] Int. Cl.[5] ..... A44B 21/00

[52] U.S. Cl. ..... 150/134; 150/143; 150/900; 224/194; 224/230; 224/252

[58] Field of Search ..... 150/101, 102, 134, 900, 150/143; 224/194, 230, 252; 2/250; 206/37.1, 38.1

[56] References Cited

U.S. PATENT DOCUMENTS

| | | | |
|---|---|---|---|
| 2,437,566 | 3/1948 | Stonebraker | 150/134 |
| 2,577,674 | 12/1951 | Broughton | 150/143 |
| 2,625,189 | 1/1953 | Knee | 150/143 |
| 2,871,902 | 2/1959 | Weil | 206/38.1 |
| 3,003,532 | 10/1961 | Nelson | 150/134 |
| 3,063,487 | 11/1962 | Mullin | 150/900 |
| 3,286,751 | 11/1966 | Dishart | 150/134 |
| 3,295,575 | 1/1967 | Young | 150/134 |
| 3,462,801 | 8/1969 | Bortle | 150/134 |
| 4,934,528 | 6/1990 | Miller et al. | 206/37.1 |
| 5,031,281 | 7/1991 | Devylder | 150/134 |

FOREIGN PATENT DOCUMENTS

| | | | |
|---|---|---|---|
| 76558 | 4/1915 | Fed. Rep. of Germany | 150/102 |
| 5615 | of 1899 | United Kingdom | 150/102 |

*Primary Examiner*—Gary E. Elkins
*Attorney, Agent, or Firm*—Patula & Associates

[57] ABSTRACT

A device for securing articles on or about the person, comprising a storage unit having an insert end and an access end, a zipper formed at the access end to access the storage space of the device, and a clip or mouth formed at the insert end for securely and releaseably engaging a desired storage location on or about the person.

13 Claims, 3 Drawing Sheets

FIG. 1
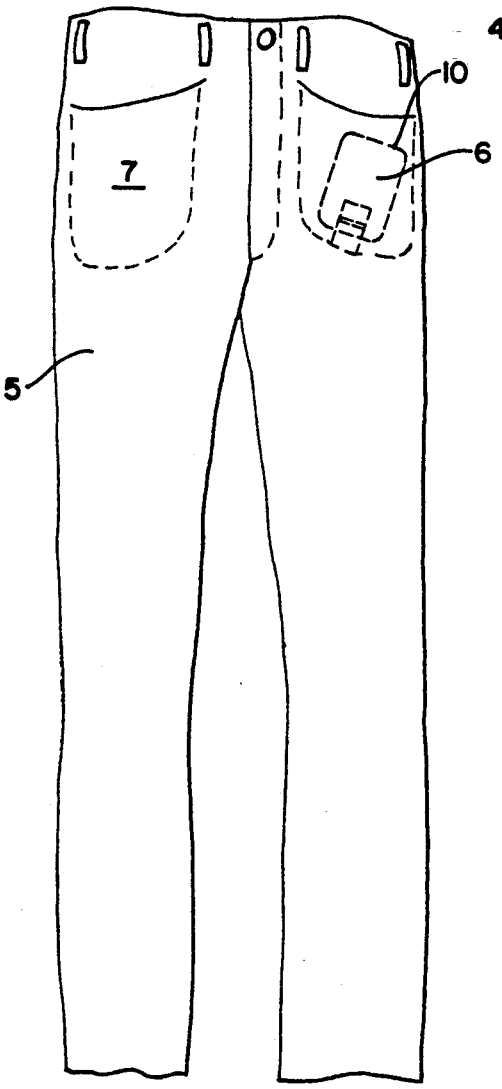
FIG. 2
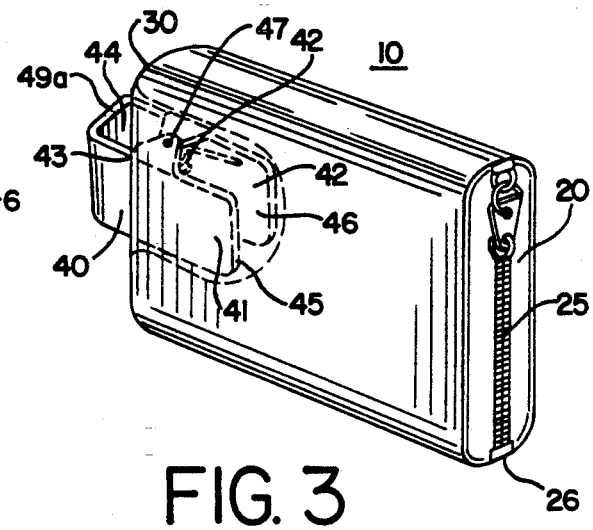
FIG. 3
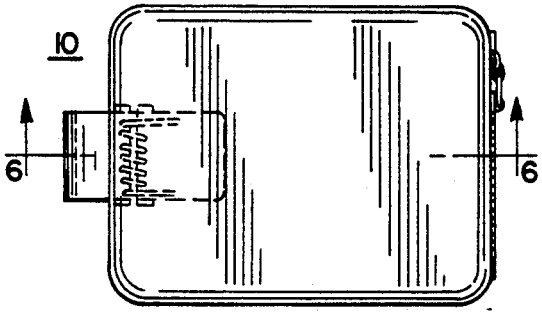
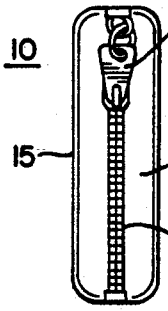
FIG. 4
FIG. 5
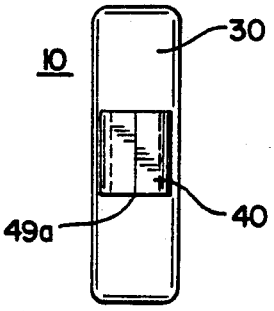
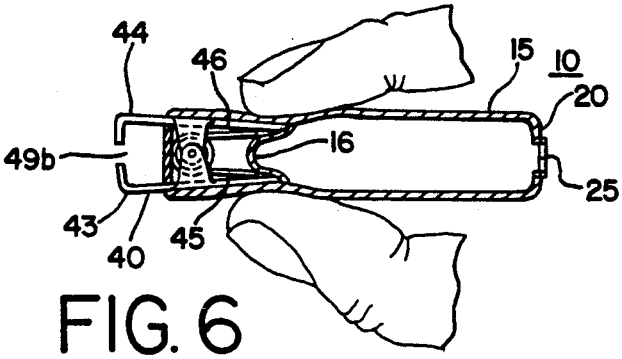
FIG. 6

DEVICE FOR SECURING ARTICLES ON OR ABOUT THE PERSON

This invention relates to security devices for articles such as wallets and the like, various items contained within wallets or pockets and, more particularly, this invention relates to security devices used to clip such articles to a desired location, such as within a pocket.

BACKGROUND OF THE INVENTION

Prior art teachings on security devices for articles carried on one's person disclose an array of measures taken to avoid the loss of an article, such as one stored within an article of clothing, like a slacks or breast pocket. These teachings attempt to address both accidental loss and intentional theft through pickpocketing. The prior art devices include a variety of security measures, including chains, strings, and friction devices, employing a variety of methodes such as magnetics, clips and teeth to inhibit removal. These devices have proven to be cumbersome to use and therefore ineffective.

The present invention improves upon the prior art in that the security component is integrally related to the article to be secured as opposed to being placed apart from the article for connecting it to the pocket or other clothing container unit. U.S. Pat. No. 4,825,922 discloses a security device which does teach the use of a security clip connected directly and immediately to a wallet by being clipped thereto, however, this reference teaches the need for a clip glued to the outside of a wallet. The configuration is problematic and ineffective partly because the acute angle configuration of the clip relative to the wallet provides minimal security effect, with the clip easily being disengaged with the use of minimal force and skill.

U.S. Pat. No. 4,241,476 also discloses a wallet security device with a theft guard system connected directly and immediately to a wallet for locking the wallet within a pocket. However, this device also is cumbersome to use and carry within a pocket because it requires the use of a bulky member having moveable locking arms to be inserted in a wallet held within a pocket. Thus, known pocket type security devices present cumbersome mechanics through the use of separate devices, such as clips, pivotable locking arms or cords, attached the article to be secured. This extra effort diminishes intended access incident to the devices use, and discourages users from implementing them.

It is therefore a principle object of the present invention to provide a device for securing an article on one's person, either within the pocket of an article of clothing or within a carrying bag worn or carried about the person, which device integrates the securing unit within its overall design and does not require independent placement or connection of the securing unit to the wallet, change-purse or other pocket type storage article.

Another object of the present invention is to provide a pocket-type security and storage device which is both attractive and easy to use to encourage continuous application of the security portion of the device without diminishing intended access of the storage portion of the device by clumsy or bulky security devices.

Yet another object of the present invention is to provide a subtle, attractive yet strong and effective security device having security means integral with a pocket-type storage article which securely holds the article within a pocket or other personal containment position and still allows for quick, uncomplicated disengagement from the secured position for removal from the pocket or other containment position.

These and other objects, features and advantages of the present invention will become apparent from the following description when considered in connection with the accompanying drawings.

SUMMARY OF THE INVENTION

The present invention is a device for securing articles to a desired location, generally on one's person such as in a coat, slacks or breast pocket of an article of clothing, or about one's person such as in a purse or carrying case. The device is comprised of a storage unit having an access end which opens and closes for accessing the storage space of the storage unit. In the preferred embodiment of the invention, the access end has a conventional zipper for opening and closing access to the storage unit, but other devices can be used for this purpose, such as ties, clips, hook-and-loop type fasteners known conventionally by the tradename "velcro", buckles, etc.

The storage unit of the present invention also has an insert end with a clip device cooperatively associated to the insert end or within the insert end for securely and releasably engaging a desired location. In a first preferred embodiment of the invention, the clip device is comprised of two clip arms pivotably associated to each other with each clip arm having a clip end and a pinch end. When the pinch ends are grasped and depressed together, the clip ends consequently are pivoted apart to allow for positioning of the desired security location between the clip ends and for gripping of the clip ends thereto when the pinch ends are released.

The desired location represented in the first preferred embodiment as shown is a clothes pocket such as that of a pair of slacks. In this embodiment, the clip ends protrude outwardly from the insert end of the storage unit, with the pinch ends being contained within the insert end and out of sight, the pinch ends being covered by the walls of the storage unit.

In the second preferred embodiment of the invention, the clip device is recessed further within the insert end of the storage unit such that the clip ends are concealed from view and not protruding outwardly as in the first embodiment. The insert end folds around each clip end of each clip arm to allow space for the grasping of the desired location between the clip ends contained within the insert end.

In the third preferred embodiment of the invention, the clip device is comprised of an expandable mouth formed of a pair of rigid members having interlocking gripping teeth. The members are longitudinally disposed in parallel alignment when the insert end is relaxed to a closed position. When the insert end is pinched at the ends, simultaneously, of the mouth, the members bow apart to form an opening for positioning of the desired security location between the gripping teeth of each of the members. When the pinching of the insert end is relaxed, the members grip the desired location as the mouth of the insert ends close into secured position. The desired location represented in the third preferred embodiment, as shown, is a breast pocket of an article of clothing, whereby pocket fabric is gripped between the members of the insert end mouth and thereby secured with the pocket.

Numerous other advantages and features of the invention will become readily apparent from the detailed description of the preferred embodiment of the invention, from the claims, and from the accompanying drawings, in which like numerals are employed to designate like parts throughout the same.

BRIEF DESCRIPTION OF THE DRAWINGS

A fuller understanding of the foregoing may be had by reference to the accompanying drawings, wherein:

FIG. 1 is a front elevational view of a pair of slacks showing the present invention secured within a pocket of the slacks.

FIG. 2 is an access end perspective view of the first embodiment of the present invention showing the clip ends protruded outwardly from the insert end and the clip arms concealed within the insert end.

FIG. 3 is a side elevational view of the present invention showing the first preferred embodiment in which the clip ends protrude outwardly from the insert end.

FIG. 4 is an elevational view of the access end of the invention.

FIG. 5 is an elevational view of the insert end of the first preferred embodiment of the present invention with the clip ends protruded outwardly from the insert end.

FIG. 6 is a cross-sectional view of the first embodiment of the invention showing the pinch ends of the clip arms being depressed to prepare for securing the invention to a desired location.

DESCRIPTION OF THE PREFERRED EMBODIMENT

Figure 7:
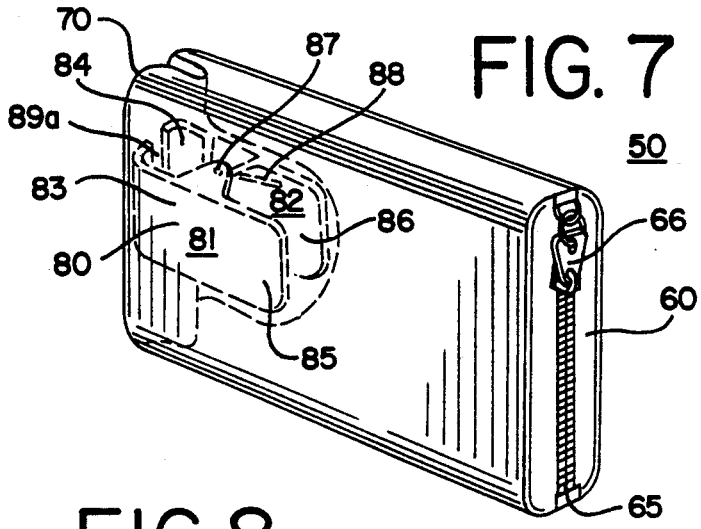
FIG. 7 is an access end perspective view of the second embodiment of the present invention showing the clip ends concealed within the insert end.

While the invention is susceptible of embodiment in many different forms there is shown in the drawings and will be described herein in detail, the preferred embodiments of the invention. It should be understood, however, that the present disclosure is to be considered an exemplification of the principles of the invention and is not intended to limit the spirit and scope of the invention and/or claims of the embodiments illustrated.

The embodiments of the present invention are shown in FIGS. 1 through 17. FIGS. 1 through 6 depict the first preferred embodiment.

Referring now to FIG. 1, a pair of slacks 5 is shown from a front elevational view. The slacks 5 have two front pockets 6 and 7, one of which is shown securing the pocket-type storage device 10 of the present invention which characterizes the first preferred embodiment. FIG. 2 shows a perspective view of the storage device 10 from its access end 20. The access end 20 opens and closes by access device 25. FIG. 2 depicts a conventional zipper 26 to provide the manner of access.

FIG. 2 also shows the insert end 30 of the storage device 10, with clip 40 protruding outwardly from the insert end 30. The clip 40 has clip arms 41 and 42. The clip arms 41 and 42 have clip ends 43 and 44, respectively, and pinch ends 45 and 46 respectively. The clip operates by pivot 47 which, as shown, employs a conventional spring biasing mechanism 48 to tense the clip 40 into a closed position 49*a* as shown in FIG. 2.

FIGS. 3 through 5 are elevational views of the device 10 of the first preferred embodiment of the invention. FIG. 3 is a side elevational view of the device 10. FIG. 4 is an access end 20 elevational view of the device 10 with the zipper 26 in a closed position. FIG. 5 is a side elevation view of the insert end 30 showing the clip 40 in the closed position 49*a*.

FIG. 6 shows a cross-sectional view of the storage device 10 taken along line 6—6 of FIG. 3, illustrating operation of the clip 40 by depressing the pinch ends 45 and 46 to pivot the clip 40 into an open position 49*b* to prepare for securing the storage device 10 to a desired location, such a within pocket 6 of slacks 5.

In the first preferred embodiment, the desired location of the device 10 is shown in FIG. 1 The storage device 10 is secured within the slacks pocket 6 of the slacks 5 by inserting the storage device 10 into the pocket 6, depressing the pinch ends 45 and 46 as shown in FIG. 6, pinching pocket 6 material between the clip ends 41 and 42 then releasing pinch ends 45 and 46 to secure the storage device 10 to the desired location.

FIG. 6 further shows exterior cover 15 wrapped around the storage device 10, including the clip 40, except for the clip ends 43 and 44, which remain exposed and protruding outwardly from the insert end 30. FIG. 6 also shows interior cover 16 which separates the clip 80 from the storage compartment 17 of the storage unit 10.

FIGS. 7 through 11 illustrate the second embodiment of the present invention. FIG. 7 shows a perspective view of the storage device 50 from its access end 60. The access end 60 opens and closes by access device 65, as in the first preferred embodiment. FIG. 7 depicts a conventional zipper 66 to provide the access within device 50.

FIG. 7 also shows the insert end 70 of the storage unit 50, with clip 80 contained within and concealed by insert end 70. The clip 80 has clip arms 81 and 82, respectively, and pinch ends 85 and 86, respectively. The clip 80 operates by a pivot 87 which, as shown, employs a conventional spring bias 88 to tense the clip 80 into a closed position 89*a* as shown in FIG. 7.

Figure 8:
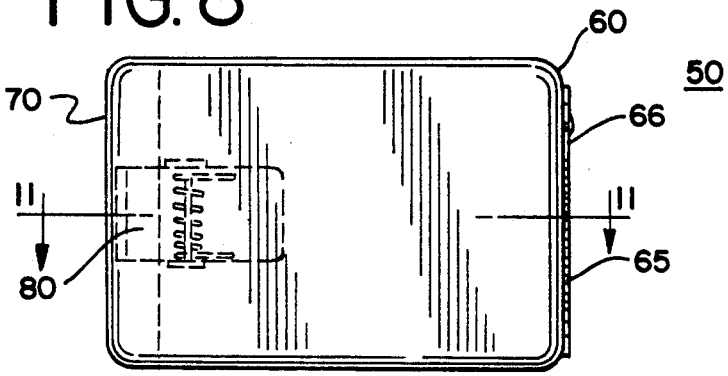
FIG. 8 is a side elevational view of the second embodiment of the present invention.
Figure 9:
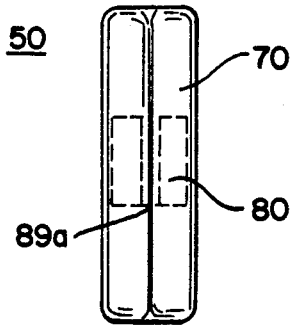
FIG. 9 is an elevational view of the insert end of the second embodiment of the present invention.
Figure 10:
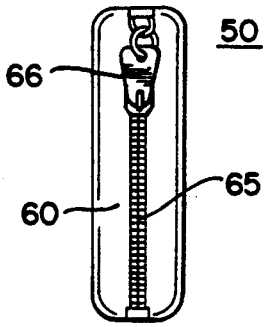
FIG. 10 is an elevational view of the access end of the second embodiment of the present invention.

FIG. 8 is a side elevational view of the device 50. FIG. 9 is a side elevational view of insert end 70 showing the clip 80 in the closed position 89*a*. FIG. 10 is an access end 60 view of the device 10 with the upper 66 of access mean 65 in a closed position.

Figure 11:
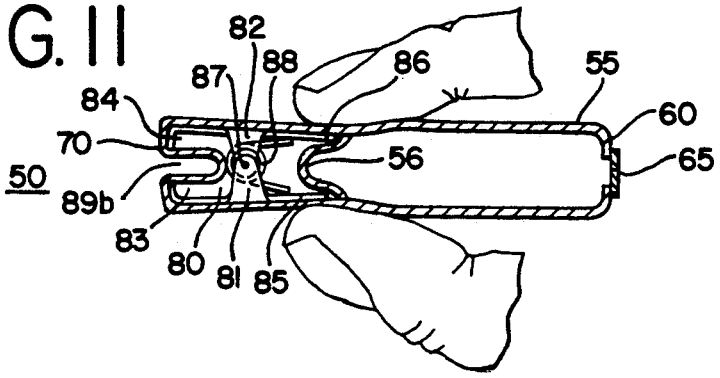
FIG. 11 is a cross-sectional view of the second embodiment of the invention showing the pinch ends of the clip arms being depressed to prepare for securing the invention to a desired location.

FIG. 11 shows a cross-sectional view of the storage device 50, taken along line 11—11 of FIG. 8, illustrating operation of the clip 80 by depressing the pinch ends 85 and 86 to pivot the clip 80 into an open position 89*b*, as done in the first preferred embodiment.

FIG. 11 also illustrates the exterior cover 55 wrapped around the storage unit 50, including the entirety of the clip 80 to cover the clip ends 83 and 84 which remain concealed within the insert end 70, but such that pinching of the desired security location still is possible. FIG. 11 also shows the interior cover 56 which separates the clip 80 from the storage compartment 57 of the storage unit 50.

Figure 12:
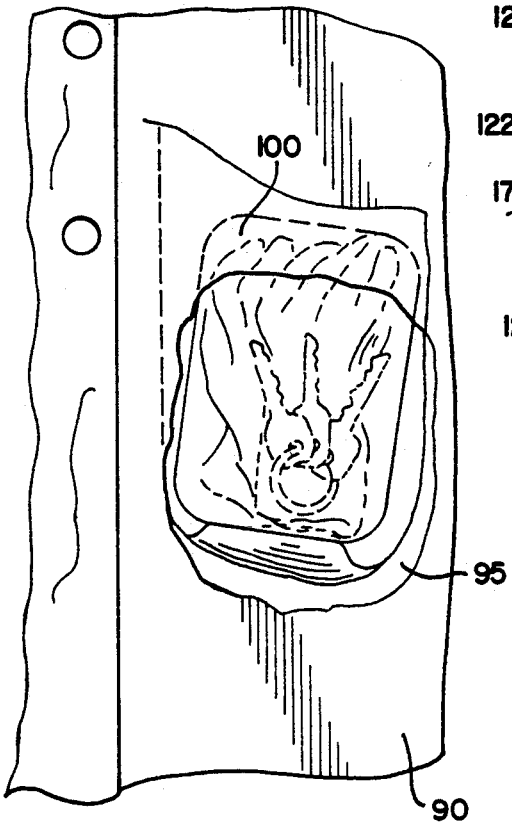
FIG. 12 is a cut away front elevational view of a breast pocket showing the present invention secured therewithin.
Figure 13:
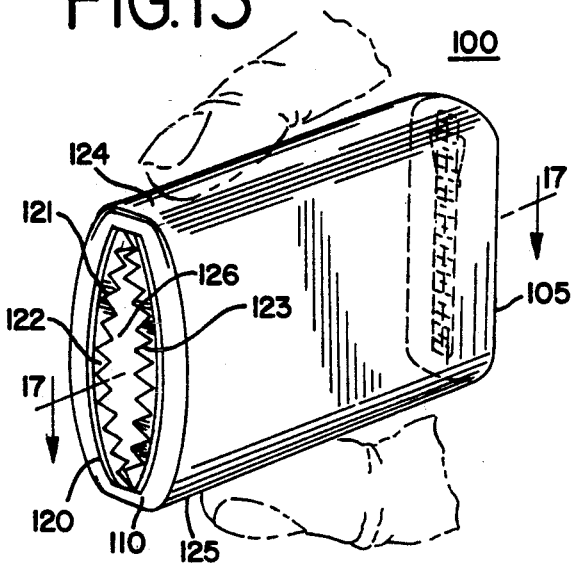
FIG. 13 is an insert end perspective view of the third embodiment of the invention showing the mouth ends being depressed to bow the mouth members for securing the insert end to a desired location.

FIGS. 12 through 17 depict the third embodiment of the invention. FIG. 12 shows the storage device 100 inserted and secured for storage within a breast pocket 95 of an article of clothing 90. FIG. 13 illustrates a perspective view of the storage unit 100 from its insert end 110. The insert end 110 has clip 120 which form a mouth 121, and is comprised of rigid members 122 and 123 which are toothed in this embodiment for enhanced gripping. The mouth 121 and insert end 110 are further defined by mouth ends 124 and 125, and a mouth opening 126 which is formed when mouth ends 124 and 125 are simultaneously depressed to cause the rigid members 122 and 123 to bow apart.

Figure 14:
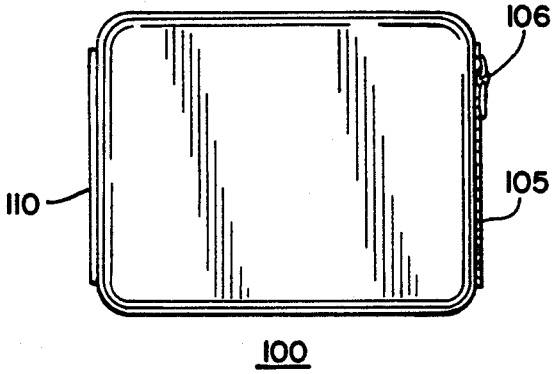
FIG. 14 is a side elevational view of the third preferred embodiment of the present invention.
Figure 15:
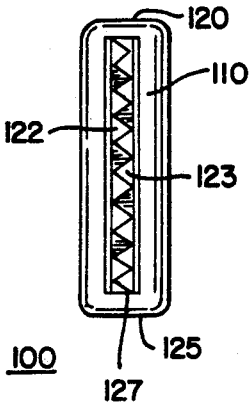
FIG. 15 is an elevational view of the insert end of the third embodiment of the present invention.
Figure 16:
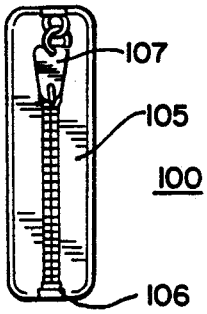
FIG. 16 is an elevational view of the access end of the third embodiment of the present invention.

FIGS. 14 through 16 show side elevational, access end 105 elevational and insert end 110 views, respectively, of the third embodiment of the present invention. FIGS. 14 and 16 show access end 105, which opens and closes by access device 106. FIG. 14 and 16 depict a conventional zipper 107 to comprise the access device 106. FIG. 15 shows a side elevational view insert end 110, with clip 120 in closed position 127.

Figure 17:
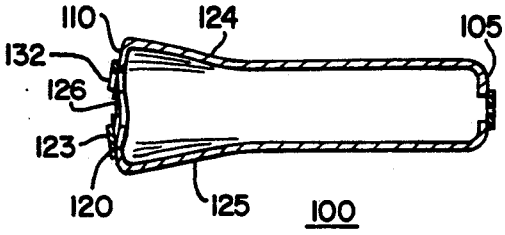
FIG. 17 is a cross-sectional view taken along line 17—17 of the third embodiment of the present invention.

FIG. 17 shows a cross-sectional view of the storage device 100, taken along line 17—17 of FIG. 13. FIG. 17 illustrates operation of the clip 120 by depressing the mouth ends 124 and 125 to bow the rigid members 122 and 123 apart to form the opening 126 to prepare for securing the storage device 100 to a desired location.

In this third embodiment, the desired location is a breast pocket 95 shown in FIG. 12. The storage device 100 is secured thereby within by inserting the storage device 100 into the pocket 95, depressing the mouth ends 124 and 125 as shown in FIG. 17, pinching pocket 95 material between the ridged members 122 and 123, then releasing the mouth ends 124 and 125 to secure the storage device 100 to the desired location, with the mouth ends 124 and 125 relaxed to closed position 127.

The foregoing specification describes only the preferred embodiments of the invention as shown. Other embodiments besides the ones shown and described above may be articulated as well. The terms and expressions therefore serve to describe the invention by example only and not to limit the invention. It is expected that others will perceive differences which, while differing from the foregoing, do not depart from the spirit and scope of the invention herein described and claimed.

I claim:

1. A device for securing articles in a desired storage location on or about a person, comprising:

a storage unit having an insert end and an access end;

security means integrally formed at said insert end for securely and directly releasably engaging said storage location on or about the person, wherein said security means is comprised of a plurality of arms cooperatively pivotably associated by spring means for biasing said arms, said arms are hidden entirely within said device by means for concealing, and said arms each having a clip end and a pinch end whereby said clip ends pivot apart when said pinch ends are depressed together, and move together to grasp said desired storage location when said pinch ends are released.

2. The device recited in claim 1 wherein said means for concealing comprises a pliable outer covering enveloping said security means.

3. The device recited in claim 1, wherein said access end is comprised of a zipper.

4. The device recited in claim 1, wherein said arms are hidden within said device by means for concealing up to said clip ends, and aid clip ends protruding visibly outwardly beyond said insert end.

5. The device recited in claim 4 wherein said means for concealing is comprised of a pliable outer covering enveloping said security means exclusive of said clip ends.

6. A device for securing articles in a desired storage location on or about a person, comprising:

a storage unit having an insert end and an access end;

security means integrally formed at said insert end for securely and directly releasably engaging said storage location on or about the person, wherein said security means comprises an expandable mouth integrally formed at said insert end, said mouth having two mouth ends and a pair of rigid members, said members being longitudinally disposed side by side to provide an opening upon depression of said mouth ends and consequent bowing apart of said rigid members.

7. The device recited in claim 6 wherein said rigid members have interlockable gripping teeth which cooperatively associate to form closure of said device when employed outside of security use, and cooperatively grip a medium placed there between during security use when said rigid members are bowed apart and released, thereby causing said gripping teeth to cooperatively hold said device securely in association with said medium.

8. A device for securing an article within a pocket of an article of clothing, comprising:

a storage unit having an insert end and an access end;

a security means integrally formed at said insert end for securely and directly releasably engaging said pocket of said article of clothing, said security means comprising a plurality of arms cooperatively pivotably associated by spring means for biasing said arms, said arms are hidden entirely within said device by means for concealing, and said arms each having a clip end and a pinch end whereby said clip ends pivot apart when said pinch ends are depressed together, and move together to grasp said pocket when said pinch ends are released.

9. The device recited in claim 8 wherein said means for concealing comprises a pliable outer covering enveloping said security means.

10. The device recited in claim 8, wherein said arms are hidden within said device by means for concealing up to said clip ends, and said clip ends protruding visibly outwardly beyond said insert end.

11. The device recited in claim 10 wherein said means for concealing is comprised of a pliable outer covering enveloping said security means exclusive of said clip ends.

12. A device for securing an article within a pocket of an article of clothing, comprising:

a storage unit having an insert end and an access end;

a security means integrally formed at said insert end for securely and releasably engaging said pocket of said article of clothing, said security means comprising an expandable mouth integrally formed at said insert end, said mouth having two mouth ends and a pair of rigid members, said members being longitudinally disposed side by side to provide an opening upon depression of said mouth ends and consequent bowing apart of said rigid members.

13. The device recited in claim 12, wherein said access end is comprised of a zipper.

* * * * *